United States Patent [19]

Muhlberger et al.

[11] Patent Number: 4,974,869

[45] Date of Patent: Dec. 4, 1990

[54] TOE UNIT FOR SAFETY SKI BINDINGS

[75] Inventors: Reinhard Muhlberger, Maria Enzersadorf; Johann Zotter; Helmut Wladar, both of Vienna; Andreas Janisch, Tribuswinkel; Hubert Wurthner, Hainburg/Donau; Alois Himmetsberger, Vienna, all of Austria

[73] Assignee: TMC Corporation, Baar/Zug, Switzerland

[21] Appl. No.: 320,631

[22] Filed: Mar. 8, 1989

[30] Foreign Application Priority Data

Mar. 10, 1988 [AT] Austria ..... 650/88

[51] Int. Cl.[5] ..... A63C 9/85

[52] U.S. Cl. ..... 280/625; 280/628; 280/634

[58] Field of Search ..... 280/634, 625, 626, 628

[56] References Cited

U.S. PATENT DOCUMENTS 4,268,064 5/1981 Svoboda ..... 280/625
4,516,792 5/1985 Scheck et al. ..... 280/625

FOREIGN PATENT DOCUMENTS 361347 4/1978 Austria .
3343943 6/1985 Fed. Rep. of Germany ..... 280/625

*Primary Examiner*—Charles A. Marmor
*Assistant Examiner*—Eric Culbreth
*Attorney, Agent, or Firm*—Finnegan, Henderson, Farabow, Garrett & Dunner

[57] ABSTRACT

A toe unit for a safety ski binding for disposal on a horizontal surface of a ski includes a base adapted to be mounted on the ski, a bolt having a lower end and an upper end, and a mounting portion for mounting the lower end of the bolt to the base. The mounting portion permits axial movement of the bolt between a first position and a second position, and secures the bolt substantially perpendicular to the horizontal surface of the ski when the bolt is in the first position. The mounting portion also permits pivotal movement of the bolt about a location on the base when the bolt is in the second position. The toe unit also includes a sole contact portion attached to the bolt for retaining a sole of a boot and for moving the bolt axially from the first position to the second position in response to a predetermined force exerted by the boot in a direction away from the base.

18 Claims, 3 Drawing Sheets

Fig.1
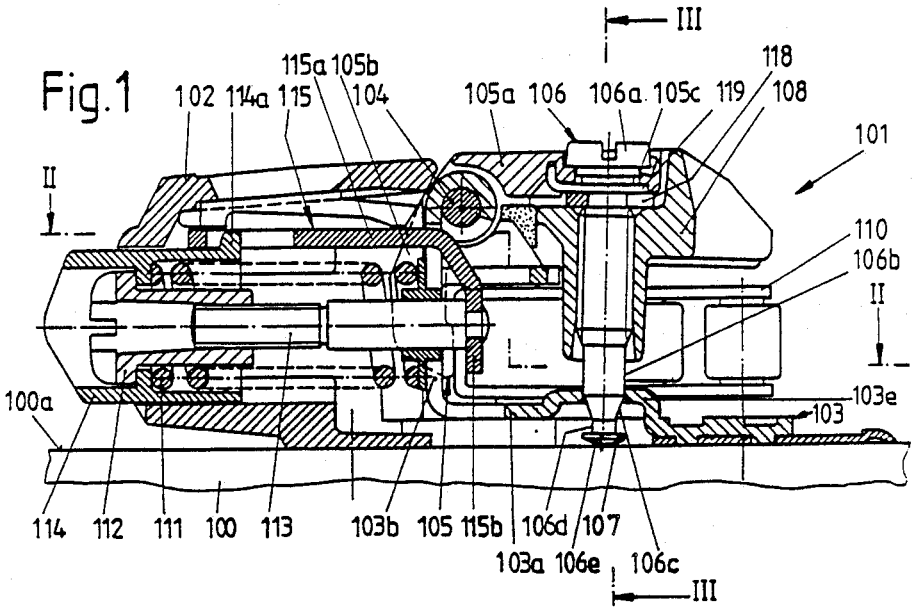
FIG.2
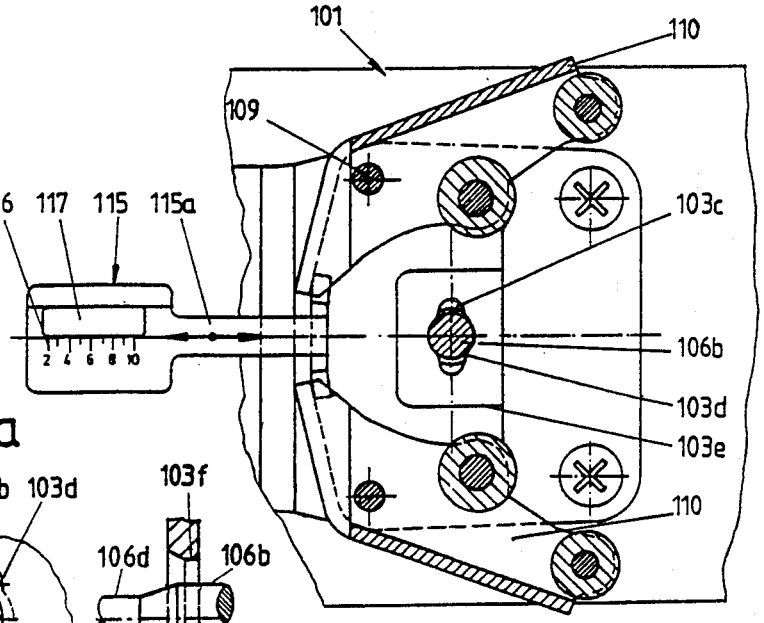
FIG.2a
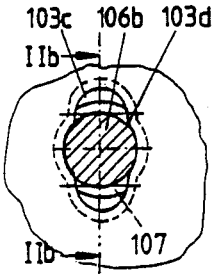
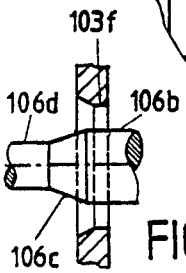
FIG.2b

Fig. 6
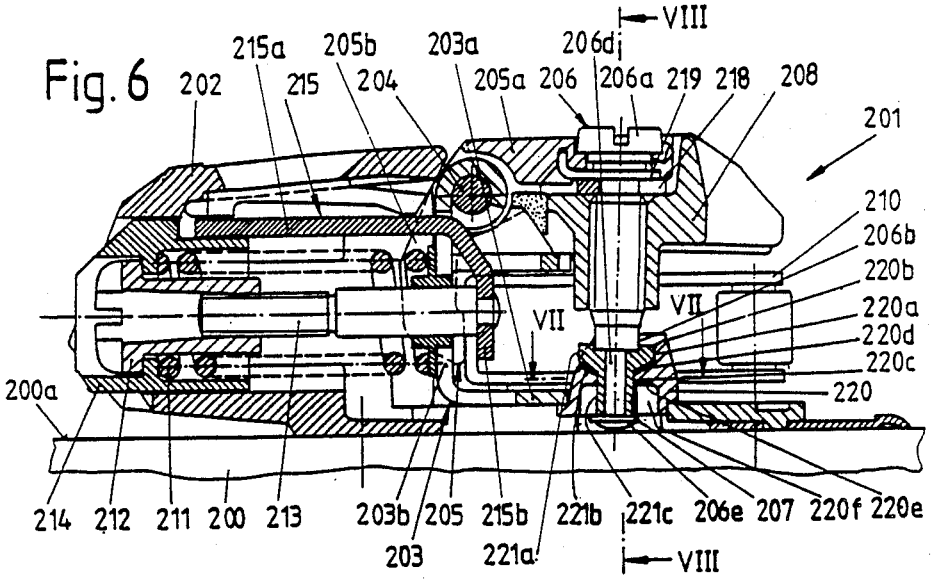
FIG. 7
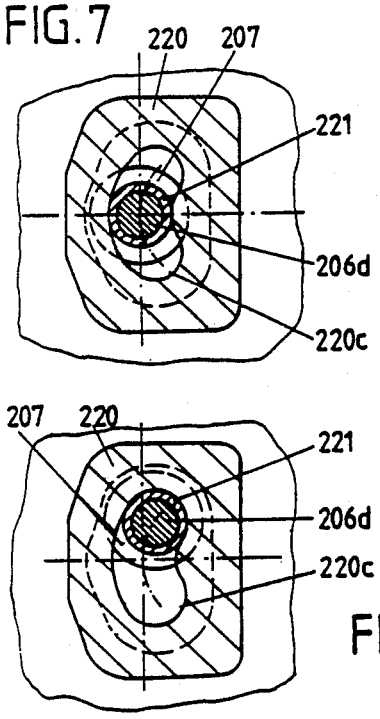
FIG. 8
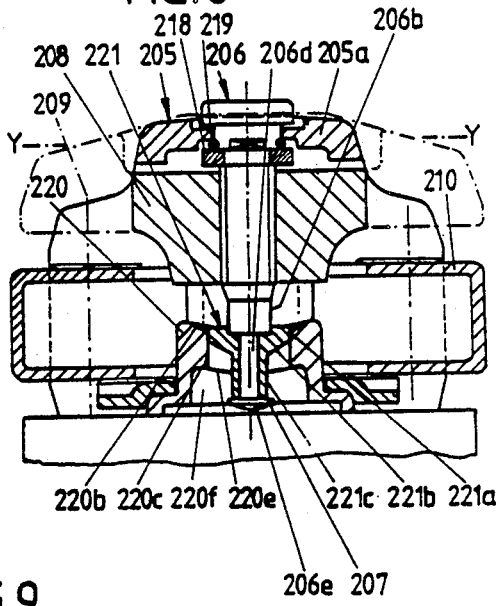
FIG. 9

TOE UNIT FOR SAFETY SKI BINDINGS

BACKGROUND OF THE INVENTION

The invention relates to a toe unit for safety ski bindings. More particularly, the invention relates to easy withdrawal of the boot in the event of a fall.

This type of toe unit kind is described in several embodiments in U.S. Pat. No. 4,268,064 to Svoboda. With the constructions shown in FIGS. 1–6, the centering of the bolt, in the running position, is effected by means of an elastic compound annularly surrounding the bolt and held in position by a component rigidly fixed to the ski. For example, although the ring shown in FIG. 6 can perform a certain elastic holding function on the bolt, and thereby on the sole retainer, it is nevertheless impossible to lock the bolt, and consequently the sole retainer, in this way through its shape. Hence, this design has the drawback that it is possible for the bolt, and thus for the sole retainer, to swivel even in the course of skiing, that is to say, at a time when the bolt carrying the sole retainer is to be held immovably in position.

By contrast, with the constructions shown in FIGS. 7–15, the bolt is locked by means of cams located on projections of the two bell-crank levers. In the event of a backward-twisting fall, release of the bolt is not possible until one of the bell-crank levers has already been swung to a specific angle by the ski boot of the skier, but this will cause a delay in the reduction of the friction between the sole retainer, and the ski boot.

SUMMARY OF THE INVENTION

The object of the invention is to overcome the drawbacks of prior constructions and to provide a toe unit which, at the onset of a backward-twisting fall by the skier, lifts the sole retainer, which, in the running position, is locked and thereby reduces without delay the friction between the sole retainer and the sole of the boot.

To achieve this object, there is provided a safety ski binding comprising two bell-crank levers which are capable of laterally embracing a boot sole and are each swingable on an axis perpendicular tot eh top of a ski against a force applied by a release spring. A sole retainer is provided and is adjustable in a direction perpendicular to the top of the ski. A bolt is mounted at its lower end in a slot in a base. The base can be, for example, a base plate or a carrying member or a control block mounted in a carrier member. The slot extends in a direction transverse to the longitudinal axis of the ski and is recessed in the base. The bolt is held in the slot in the running position. The object of the invention is achieved by centering the bolt in the running position by use of a cylindrical guide surface in the base. In the event of a backward fall, the bolt can be moved to a limited extend relative to the base. This movement occurs in a direction substantially perpendicular to the top of the ski against the force of a release spring. In the event of a backward-twisting fall by a skier, the bolt moves relative to the base and is released from the cylindrical guide surface, thereby allowing the sole retainer to move laterally. If the skier falls backward while skiing, the sole retainer is lifted, thereby unlocking the bolt. If there is a backward-twisting fall as well, the sole retainer can swing sideways without delay, ensuring release of the boot sole with little friction.

There are mainly two solutions which present themselves for the concrete construction of this toe unit. Of these, the approach set forth in the first embodiment of the present invention is particularly simple. Since the slot that has already been hollowed out must be widened cylindrically in its central region and adapted to the bolt already present. The conical constriction extending behind the shank increases the capability of the screw bolt to swing and facilitates its centering during resetting as well.

A compact overall height of the toe unit is ensured by the present invention.

The present invention makes it possible that, in the event of a backward-twisting fall by the skier, the sole retainer will not only swing sideways, but will be lifted at its rear end as well.

In practice, it has proven advantageous to locate in two planes the centering of the lower end of the bolt, in the running position, and guiding the lower end of the bolt in the event of a twisting fall backwards by the skier. This step makes it possible to make the surfaces governing the guiding and centering sufficiently large so as to reliably prevent them from being deflected by the bolt.

Improved centering is ensured by the features of the present invention.

The path and the position of the bolt, in the event of a backward fall by the skier, are defined by the present invention.

The present invention enables the head of the screw bolt to be locked against axial movement similar to a spherical joint.

BRIEF DESCRIPTION OF THE DRAWINGS

Two illustrative embodiments of the subject of the invention are shown in the drawings.

FIG. 1 is a vertical cross-sectional side view of a first embodiment of the present invention;

FIG. 2 is a partial cross-sectional view taken along line II—II of FIG. 1;

FIG. 2*a* is an enlarged detail of FIG. 2;

FIG. 2*b* is a cross-sectional view taken along line IIb—IIb in FIG. 2*a*.

FIG. 6 is a vertical cross-sectional side view of a second embodiment of the present invention;

FIG. 7 is a partial enlarged cross-sectional view taken along line VII—VII of FIG. 6;

FIG. 8 is a cross-sectional view taken along line VIII—VIII of FIG. 6; and FIG. 9 corresponds to FIG. 7, but with the sole retainer in a horizontally swung position.

DESCRIPTION OF THE PREFERRED EMBODIMENTS

Figure 3:
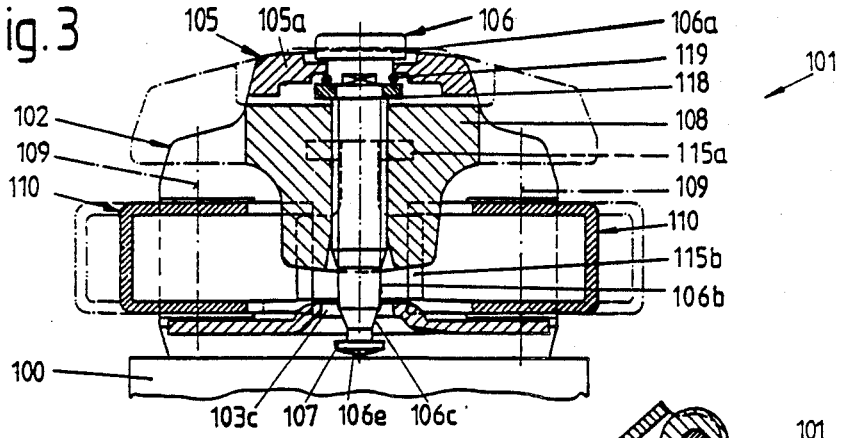
FIG. 3 is a cross-sectional view taken along line III—III in FIG. 1.
Figure 4:
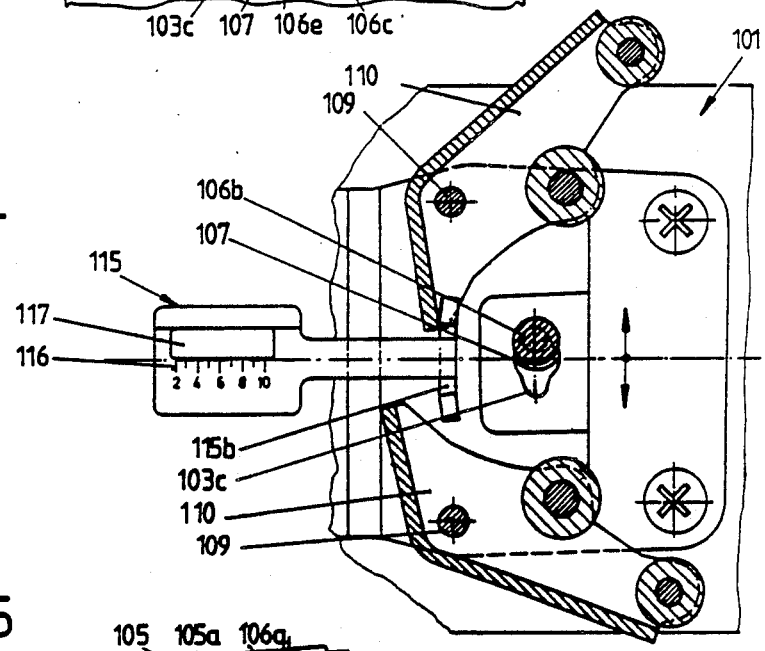
FIGS. 4 and 5 correspond to FIGS. 2 and 3, respectively, but with the sole retainer in a horizontally swung position.
Figure 5:
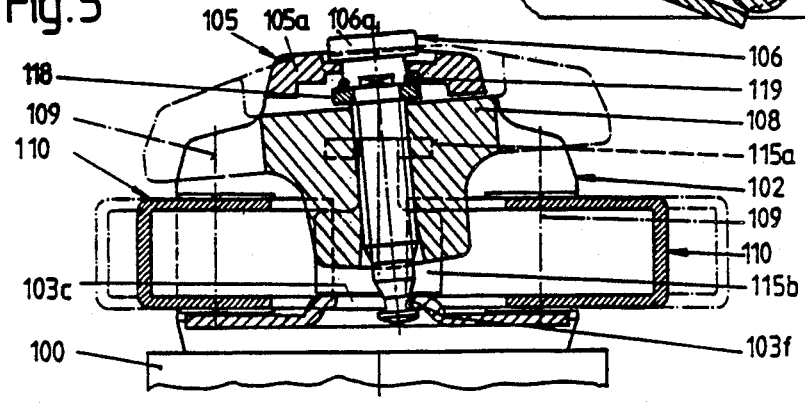

The toe unit depicted in the FIGS. 1–5 is generally designated with the reference numeral 101. The toe unit 101 has a casing 102, to which is attached a carrying member 103, which, a vertical longitudinal median section, is substantially angular in shape. The casing 102 and the horizontal leg 103*a* of the carrying member 103 are attached in a known manner to the top 100*a* of a ski 100. The other leg 103*b* of the carrying member 103 extends perpendicularly to the top 100*a* of the ski 100 and carries at its upper end an arbor 104 placed in a direction transverse to the longitudinal axis of the ski and in parallel with the top 100*a*of the ski 100. An angular compensating lever 105 is mounted on the arbor 104, one leg 105*a* of which extends horizontally and substantially in parallel with the leg 103*a* of the carrying member 103. Recessed in the leg 105*a* of the compensating lever 105 is a vertically extending bore 105*c* through which is passed a screw bolt 106 having a shank 106*b* and a thread which is engaged in a tap hole in a sole retainer 108. The head 106*a* of the screw bolt 106 rests on the horizontal leg 105*a* of the compensating lever 105 and enables the screw bolt to swing in all directions by means of a mounting arrangement similar to a spherical joint. In its set position, the screw bolt 106 is prevented from turning by a torsion spring 119, which is braced on flattened areas underneath the head 106*a* of the screw bolt 106. The ends of the spring are anchored in the leg 105*a* of the compensating lever 105. An insert 118, having the form of a U in top plan view, which is pushed onto the screw bolt 106 and enables its head 106*a* to be mounted with a clearance in the leg 105*a* of the compensating lever 105, is located beneath the torsion spring 119. There extends behind the lower end section of the shank 106*b* of the screw bolt 106 a conical constriction 106*c*, which passes into a cylindrical extension 106*d*, which carries a coaxially disposed shim 107 held in position by means of a rivet head 106*e* and which limits the sliding path of the screw bolt 106 and thereby the angle of traverse of the compensating lever 105.

A slot 103*c* is disposed in an upwardly directed bulge of the horizontal leg 103*a* of the carrying member 103. Slot 103*c* may, for example, be rectangular. In its mid section, the slot 103*c* is provided with a cylindrical enlargement 103*d* designed to engage the cylindrical shank 106*b* of the screw bolt 106. Furthermore, in its lower section, the limiting wall 103*f* of the slot 103*c* is beveled conically (cf. FIGS. 2*a* and 2*b*) so as to enable the bolt 106 to swing sideways in its lifted state.

The known structure of the toe unit 101 is as follows: The leg 103*a* of the carrying member 103, spaced apart laterally from the vertical longitudinal median plane of the toe unit 101, carries two vertical arbors 109, on each of which is mounted a bell-crank lever 110, one leg of which serves as a lateral holding means for the boot sole of a ski boot (not shown) inserted into the toe unit 101. The other leg cooperates with a sliding part 115 to be described more fully hereinafter.

A release spring 111 extending along the longitudinal axis of the toe unit 101 and taking the form of a pressure spring is housed in the casing 102. The initial tension of this release spring 111 can be set by means of a sleeve 112 with female thread. The sleeve 112 is screwed onto the threaded section of a pull rod 113, which passes dead center through the release spring 111. Another sleeve 114, acting as a spring plate, is braced on a collar of the sleeve 112.

On the end adjacent to the ski boot, the pull rod 113 carries the sliding part 115, which is angular when viewed in a vertical longitudinal median section through the toe unit 101. The pull rod 113 is inserted with its offset end into a bore in the vertically extending leg 115*b* of the sliding part 115 and riveted. As a result, a pull is exerted on the sliding part 115 by the release spring 111 toward the tip of the ski. The sliding part 115 acts upon each of the two lateral bell-crank levers 110, as well as on the compensating lever 105.

The leg 115*a* of the sliding part 115, parallel to the top 100*a* of the ski 100 and pointing toward the tip of the ski, has a scale 116 with a slit 117 in which a mark 114*a*, attached to the sleeve 114, is movably guided.

If the skier falls backward, the sole retainer 108 is first lifted, but at the same time the compensating lever 105 is also swung and the screw bolt 106 moved upward until the shim 107 abuts against the bottom of the bulge 103*e* of the leg 103*a* of the carrying member 103. The cylindrical shank 106*b* of the screw bolt 106 is now released from the embrace of the cylindrical enlargement 103*d*, and the extension 106*d* of the screw bolt 106 can move, should a back-ward-twisting fall occur, toward one end of the slot 103*c*. This enables the screw bolt 106 to assume an inclined position as a result of the bevel of the limiting wall 103*f* of the slot 103*c*, and facilitates the swinging of the head 106*a* of the screw bolt 106 on account of the free space between the torsion spring 119 and the insert 118 on the compensating lever 105.

Once the ski boot has emerged from the toe unit 101, the release spring 111, by means of the compensating lever 105, returns the sole retainer 108 to its initial position, urging the screw bolt 106 downward. As a result, the cylindrical shank 106*b* moves into the cylindrical enlargement 103*d* of the slot 103*c*, causing the screw bolt 106 to be centered. Thereupon, the sole retainer 108 is again in the position where it is approximately parallel to the top 100*a* of the ski 100.

The embodiment of a toe unit 201 illustrated in FIGS. 6–9 is similar to that described hereinabove. Therefore, the individual components of the toe unit 201 corresponding to the components of the first embodiment are not described separately and are designated with reference numerals higher than 100.

Unlike the first embodiment, the slot 220*c*, is not hollowed out in the leg 203*a* of the carrying member 203, but rather at a median level of a control block 220. The control block 220 is immovably secured in a recess of the leg 203*a* and retained by the casing 202 after the toe unit 201 has been assembled. The slot 220*c* in top plan view is substantially kidney shaped with the concave bend being turned toward the ski boot. A conical depression 220*b*, followed by a cylindrical opening 220*a* and thereafter by an opening 220*d*, is spaced a distance above the slot 220*c* in the control block 220. In the control block 220, a cavity 220*f* with a roof 220*e* is recessed beneath the slot 220*c*, to which it is parallel.

The screw bolt 206 in this illustrative embodiment has a cylindrical shank section 206*b* located beneath the threaded section. The cylindrical shank section 206*b* passes over a step into a cylindrical end section 206*d*. A sleeve 221, which will be described in more detail hereinbelow, is mounted thereon.

Here, too, in order to prevent the sleeve 221 from moving downward accidentally, the screw bolt 206 has at its lower end a coaxial shim 207 held in position by means of a rivet head 206*e*. Furthermore, the roof 220*e* of the cavity 220*f* is curved convexly downward in the shape of a circular arc (see FIG. 8), resulting in a well-defined position of the horizontally swung screw bolt 206, and hence also of the sole retainer 208.

If the skier falls backward, the sole retainer 208 will first be lifted, but concurrently the compensating lever 205 will also be swung and the screw bolt 206, as well as the sleeve 221, be moved upward until the shim 207 abuts against the roof 220*e* of the cavity 220*f* of the control block 220. The cylindrical part 221*a* of the sleeve 221 is now released from the embrace of the cylindrical opening 220*a* and, if a backward-twisting fall occurs, the cylindrical end section 221*c* of the sleeve 221 can move toward either end of the slot 220*c*, causing the sole retainer 208 to assume an inclined position relative to the longitudinal axis of the ski. Due to the banana or kidney shape of the slot 220*c*, the sole retainer 208 will also be swung somewhat on an ideal cross axis Y—Y, thereby additionally facilitating removal of the ski boot by the skier from the toe unit 201 in the event of a backward-twisting fall.

Once the ski boot has emerged from the toe unit 201, the release spring 211, by means of the compensating lever 205, returns the sole retainer 208 to its initial position, thereby pressing the screw bolt 206 and the sleeve 221 downward. As a result, the conical depression 220*b* of the control block 220 guides the cylindrical part 221*a* of the sleeve 221 back into the cylindrical opening 220*a* of the control block 220 via the conical section 221*b* of the sleeve 221, which causes the screw bolt 206 to be centered. The apex angle of the conical section 221*b* of the sleeve 221 corresponds to the apex angle of the conical depression 220*b* of the control block 220.

The invention is not limited to the specific embodiments illustrated in the drawing and described hereinabove. Rather, various modifications thereof are possible without departing from the spirit and scope of the underlying inventive concept. For example, it would be conceivable in the case of the second embodiment to provide the sleeve which is attached to the screw bolt with a hollowconed step, to which is assigned an upwardly directed conical surface of the pedestal. The bolt may also be smooth, with the the sole retainer being automatically adjustable against the force of a pressure spring extending along the bolt. Additionally, the banana or kidney shape of the slot can be utilized in the first embodiment.

We claim:

1. A toe unit for a safety ski binding for disposal on a horizontal surface of a ski, the toe unit comprising:

a base adapted to be mounted on the ski;

a bolt having a lower end and an upper end;

means for mounting said lower end of said bolt to said base, said mounting means permitting movement of said bolt along a ball axis between a first position and a second position, said mounting means including means for securing said bolt substantially perpendicular to the horizontal surface of the ski when said bolt is in said first position, and means for permitting pivotal movement of said bolt about a location on said base when said bolt is in said second position;

sole contact means attached to said bolt for retaining a sole of a boot and for moving said bolt axially from said first position to said second position in response to a predetermined force exerted by the boot in a direction away from said base.

2. The toe unit of claim 1, wherein said mounting means includes an elongated slot formed in said base for receiving the lower end of the bolt, said securing means includes a central guide surface disposed in said slot and a seating surface disposed on said bolt, said seating surface substantially conforming to said guide surface.

3. The toe unit of claim 2, wherein said slot is substantially kidney shaped.

4. The toe unit of claim 2, wherein said bolt includes a constricted area disposed beneath said seating surface and said slot includes opposing side portions disposed adjacent said central guide surface, said pivotal movement permitting means including said constricted area and said opposing side portions.

5. The toe unit of claim 1, wherein said mounting means includes a slot in said base for receiving the lower end of said bolt and a shim disposed on the lower end of said bolt for preventing the bolt from being removed from the slot.

6. The toe unit of claim 5, wherein said base includes a bulged portion and said slot is disposed in said bulged portion.

7. The toe unit of claim 1, wherein said base includes a block having a concave guide portion and an elongated slot disposed beneath said concave guide portion, and said bolt includes a sleeve disposed thereon, said sleeve including a conical section substantially conforming to said concave guide portion, said securing means including said concave guide portion and said conical section.

8. The toe unit of claim 7, wherein said slot is substantially kidney shaped.

9. The toe unit of claim 7, wherein said sleeve includes a constricted portion disposed beneath said conical section, said pivotal movement permitting means including said constricted portion and said elongated slot.

10. The toe unit of claim 1, wherein said sole contact means includes a sole contact surface disposed above said base, said bolt for maintaining said sole contact surface substantially parallel to the horizontal surface of the ski when said bolt is in said first position.

11. The toe nit of claim 10, wherein said bolt is adjustable to selectively vary the distance between said sole contact surface and said base.

12. The toe unit of claim 11, wherein said bolt includes a threaded portion for engaging a threaded portion on the sole contact means.

13. The toe unit of claim 1, further comprising spring means for supplying a force to said sole contact means to oppose a force exerted on said sole contact means by a boot.

14. The toe unit of claim 1, further comprising first and second bell-crank levers for embracing the toe of a boot, each bell-crank lever being pivotable about a corresponding axis, each corresponding axis being substantially orthogonal to the horizontal surface of the ski.

15. The toe unit of claim 14, further comprising spring means for supplying a force to said sole contact means to oppose a force exerted on said sole contact means by a boot and to oppose a force exerted upon said bell crank levers by a boot.

16. The toe unit of claim 1, wherein said sole contact means includes a sole retainer and an angular compensating lever.

17. The toe unit of claim 16, further comprising a torsion spring disposed between said angular compensating lever and said sole retainer.

18. The toe unit of claim 16, further comprising a U-shaped insert disposed between said angular compensating lever and said sole retainer.

* * * * *

UNITED STATES PATENT AND TRADEMARK OFFICE

CERTIFICATE OF CORRECTION

PATENT NO. :4,974,869

DATED :December 4, 1990

INVENTOR(S) :Muhlberger et al

It is certified that error appears in the above-identified patent and that said Letters Patent is hereby corrected as shown below:

Claim 1, column 5, line 44, change "ball" to --bolt--.

Claim 11, column 6, line 35, change "nit" to --unit--.

Signed and Sealed this

Twenty-first Day of April, 1992

*Attest:*

HARRY F. MANBECK, JR.

*Attesting Officer*

*Commissioner of Patents and Trademarks*